US005933118A

United States Patent [19]

Kakizawa

[11] Patent Number: 5,933,118

[45] Date of Patent: Aug. 3, 1999

[54] WINDOW GLASS ANTENNA SYSTEM

[75] Inventor: Hitoshi Kakizawa, Osaka, Japan

[73] Assignee: Nippon Sheet Glass Co., Ltd., Japan

[21] Appl. No.: 08/840,541

[22] Filed: Apr. 22, 1997

[30] Foreign Application Priority Data

Apr. 23, 1996 [JP] Japan ..... 8-101559

[51] Int. Cl.[6] ..... H01Q 1/32

[52] U.S. Cl. ..... 343/713; 343/704; 343/713

[58] Field of Search ..... 343/713, 704; H01Q 1/32

[56] References Cited

U.S. PATENT DOCUMENTS 5,557,289 9/1996 Ohara ..... 343/713
5,629,711 5/1997 Matsuoka et al. ..... 343/704

FOREIGN PATENT DOCUMENTS 6318811 11/1994 Japan .
7245516 9/1995 Japan .

*Primary Examiner*—Robert H. Kim
*Assistant Examiner*—Layla G. Lauchman
*Attorney, Agent, or Firm*—Adams & Wilks

[57] ABSTRACT

A window glass antenna system is attached to a surface of a pane of vehicular window glass and comprises an antenna switching circuit attached directly onto the window glass pane in close proximity to antennas of the system for switching over the antennas. The antenna switching circuit has a plurality of mounting terminals and a plurality of input signal lines connected to the mounting terminals which in turn are fixedly secured to power terminals fixed to the window glass pane for powering the antennas. The thus-arranged antenna system has improved directional repeatability and reception sensitivity in that the antenna switching circuit is positioned closely to the antennas and connected to the antenna powering terminals without requiring the use of any elements that may form part of the antennas during operation thereof.

4 Claims, 4 Drawing Sheets

WINDOW GLASS ANTENNA SYSTEM

BACKGROUND OF THE INVENTION

1. Field of the Invention

The present invention relates generally to a vehicular window glass antenna system and, in particular, to a window glass antenna system in which directional repeatability and reception sensitivity are improved by attaching an antenna switching circuit in the form of a printed-circuit board directly onto a pane of vehicular window glass.

2. Description of the Related Art

Japanese Patent Laid-Open Publication No. HEI 6-318811 and No. HEI 7-245516, both assigned to the assignees of this application, disclose a window glass antenna system, as shown in FIG. 4 hereof. The window glass antenna system 41 comprises a plurality of antennas 43, 44 and a defogging-heater/antenna 45, which are disposed on a pane of window glass 42 for receiving AM/FM radio and TV broadcast bands. The antenna system 41 also includes a plurality of power terminals 53, 54, 55 disposed on the window glass pane 42 for supplying power to the antennas 43, 44 and heater/antenna 45, and an antenna switching circuit 49 disposed externally of the window glass pane 42. The antenna switching circuit 49 has input terminals 33, 34, 35 connected to the power terminals 53, 54, 55 via respective power cables 33*a*, 34*a*, 35*a*. The antennas 43, 44 and heater/antenna 45 are switched over by control signals transmitted through a control signal cable 47. Received signals are taken out via a coaxial cable 48.

The window glass antenna system is advantageous in that since received signals can be taken out not only in their independent forms but also in combined forms, different kinds of received signals, which are greater in number than the number of the provided antennas, are obtainable. The system also has the advantage that since it incorporates the antenna switching circuit for switching the antennas one over the other so that the antennas may be used exclusively as an AM/FM radio or TV broadcast band receiver, interference between the AM/FM and TV antennas can be avoided.

However, in the prior window antenna system, since the power cables 33*a*, 34*a*, 35*a* are used for the connection of the input terminals 33, 34, 35 of the antenna switching circuit with the antenna powering terminals 53, 54, 55, the power cables 33*a*, 34*a*, 35*a* form part of the antennas 43, 44, 45 during operation thereof, whereby stray capacitance resulting from the power cables varies depending on the mode of mounting thereof, causing the antenna impedance to vary. This may result in deterioration of the directional repeatability and reception sensitivity of the antennas, thus requiring an extra time for antenna tuning.

Additionally, recent automobiles are designed such that the least running and engine noises may come inside the automobiles so as to provide the occupants of the automobiles with optimal comfort. As a result, faint noises, which have not been cared at all in the past, are much cared now.

Consequently, there is a demand for the provision of a window glass antenna system with improved directional repeatability and reception sensitivity.

SUMMARY OF THE INVENTION

It is therefore an object of the present invention to provide a window glass antenna system with improved directional repeatability and reception sensitivity.

According to one aspect of the present invention, there is provided a window glass antenna system which comprises a plurality of antennas attached to a surface of a vehicular window glass, a plurality of power terminals attached to the window glass surface and connected to the antennas for supplying power thereto, and an antenna switching circuit attached directly to the window glass surface in close proximity to the antennas for switching over the antennas, the antenna switching circuit having a plurality of mounting terminals and a plurality of input signal lines connected to the mounting terminals, the mounting terminals being fixedly secured to the power terminals.

Preferably, the antenna switching circuit takes the form of a printed-circuit board or a printed film.

One of the antennas may comprise a defogging-heater/antenna designed to operate as a defogging heater and an antenna.

Since the antenna switching circuit takes the form of a printed-circuit board or printed film and has plural mounting terminals, it can be attached directly onto the window glass surface in close proximity to the antennas. As a result, the antenna switching circuit, or printed-circuit board or a printed film, can be connected directly to the antenna powering terminals without requiring the use of elements that may vary the stray capacitance or form part of the antennas during operation thereof, whereby improved directional repeatability and reception sensitivity can be achieved in the window glass antenna system.

Additional objects, advantages and features of the present invention will become apparent from the following description and appended claims, taken in conjunction with the accompanying drawings.

DETAILED DESCRIPTION OF THE PREFERRED EMBODIMENT

Figure 1:
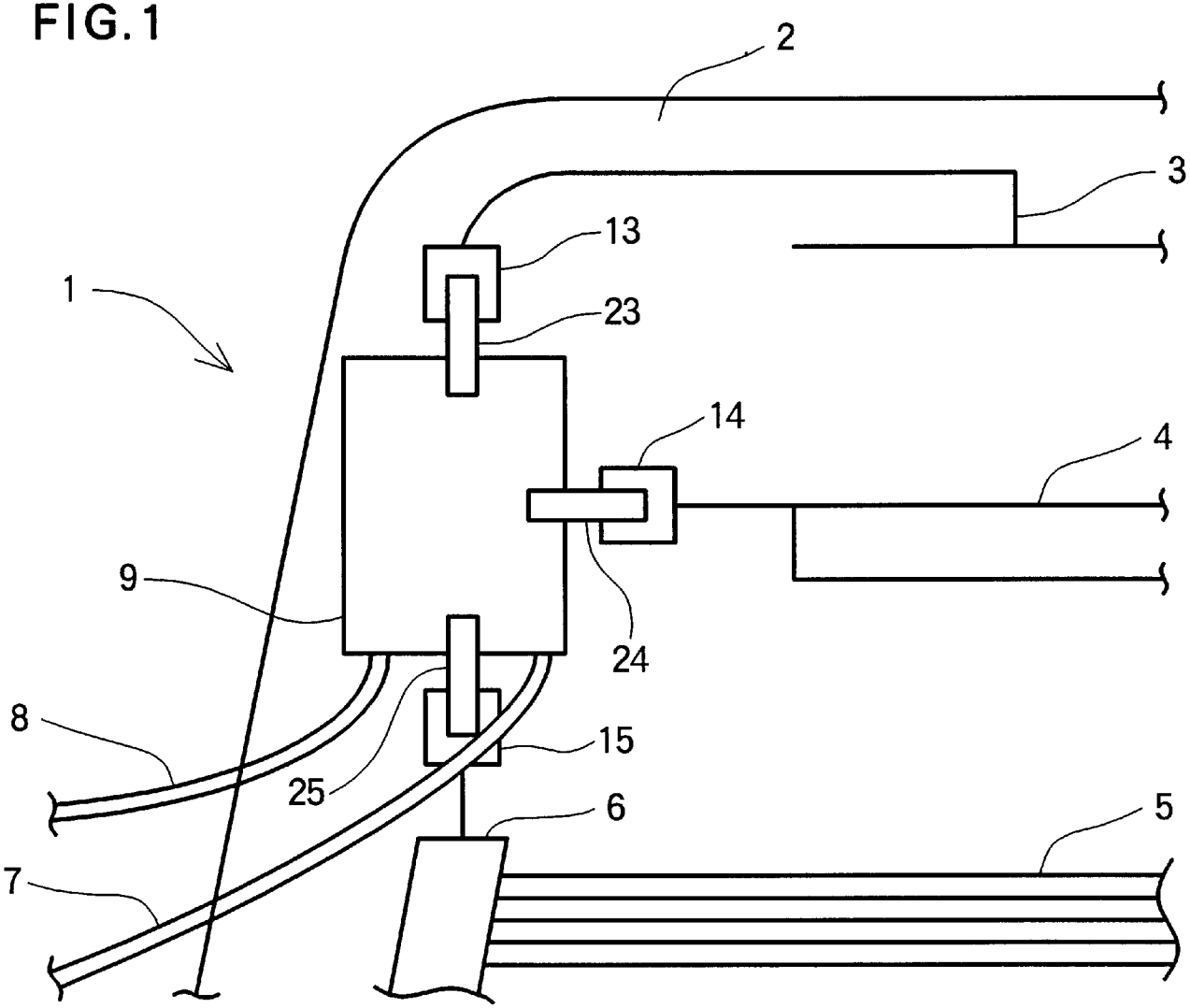
FIG. 1 is a schematic view illustrating a general arrangement of a window glass antenna system according to the present invention.

A preferred embodiment of the present invention will now be described, by way of example only, with reference to FIG. 1 and FIG. 2.

Window glass antenna system according to the present invention, generally designated by reference numeral 1, is attached to a surface of a pane of vehicular window glass 2. The antenna system 1 comprises a plurality of antennas 3, 4 and a defogging-heater/antenna 5, and an antenna switching circuit 9.

Uppermost antenna 3 is designed to receive, for example, AM/FM radio broadcast waves while the antenna 4 is designed to receive, for example, TV broadcast waves. The defogging-heater/antenna 5 comprises a plurality of heater/antenna strips connected together by means of a conductive terminal 6 and operates as a defogging heater and a secondary TV antenna. The antennas 3, 4, 5 are electrically connected to respective power terminals 13, 14, 15 fixed to the window glass surface and supplied power therethrough.

Antenna switching circuit 9 has a plurality of input signal lines a3, a4, a5 for transmitting input signals for switching over the antennas 3, 4 and defogging-heater/antenna 5 from one to another. The antenna switching circuit 9 also has a plurality of mounting terminals 23, 24, 25, which are connected electrically to the respective input signal lines a3, a4, a5. The mounting terminals 23, 24, 25 projecting outwardly from the antenna switching circuit 9 are fixedly secured to the antenna powering terminals 13, 14, 15 by soldering.

In a specific form, the antenna switching circuit 9 is incorporated in a printed-wiring board with the mounting terminals 23, 24, 25 projecting outwardly therefrom for solder connection to the antenna powering terminals 13, 14, 15.

Antenna switching circuit 9 further includes an output signal line z connected to a single coaxial cable 8 for outputting signals therethrough, and five control signal lines s connected to a control signal cable 7 for transmitting control signals.

Designated by reference numeral 8*a* is a point of connection of the output signal line z and coaxial cable 8. Reference numeral 7*a* designates points of connection of the control signal lines s and control signal cable 7.

Four among the five control signal lines s are connected through choke coils L1, L3, L4, L5 to the anodes of pin diodes D1, D3, D4, D5. The mounting terminals 23, 24, 25 are connected to the anodes of the pin diodes D1, D3, D4, D5. The remaining one of the five control signal lines s is connected through a choke coil L0 to the sole output signal line z of the antenna switching circuit 9. Similarly, the cathodes of the pin diodes D1, D3, D4, D5 are connected to the sole output signal line z of the switching circuit 9.

It may be readily appreciated by those skilled in the art that pin diodes are advantageous in that they have quick response capability while they produce little junction capacitance.

Antenna switching circuit 9 has a balun B for preventing passage of in-phase current therethrough so that an additional antenna can be provided by combining the independent antennas 3, 4. In other words, the antennas 3, 4 and defogging-heater/antenna 5 are arranged such that they can serve as independent antennas by switching them one over the other while additional reception signals can be extracted from the antennas 3, 4 by connecting the latter to the balun B. By virtue of the action of the balun B to prevent passage of in-phase current therethrough, an additional antenna is provided in which the antenna 3 is patterned for radiation and the antenna 4 is patterned for grounding.

When desired, an LSI, CR filter or any other like circuits may be printed on the switching circuit 9 so that before attenuation of the received signals and superimposition of noises thereupon, the received signals can be subjected to required processing for subsequent extraction through the coaxial cable. Additional features of the antenna switching circuit are described in the aforementioned Japanese Patent Laid-Open Publication No. HEI 7-245516, the contents of which are incorporated herein by reference.

Although the switching circuit 9 further includes coupling capacitors C1, C3, they are not essential and may be provided only when needed. Similarly, the balun B, diode D1 and choke coil L1 are not always required and may be provided when desired.

There may be provided a conductor strip (not shown) having one end carrying a press fixed terminal connected to a part of a vehicle body adjacent to the printed-wiring board (switching circuit) 9 on the window glass 2, and an opposite end connected to a grounded line of the switching circuit (printed-wiring board) 9.

In place of the printed-circuit board 9, a printed film may be used. Such printed film may be desirably a transparent, flexible printed-wiring film. If desired, a balun, LSI or CR filter may be printed on the film. Since the printed film is flexible, it can be properly positioned on the window glass pane by bending it even when the antenna powering terminals and mounting terminals to be solder connected thereto are displaced from each other. Also, since it is transparent, the printed film does not adversely affect the aesthetic appearance of the vehicular window, nor does it narrow a field of view.

Figure 3:
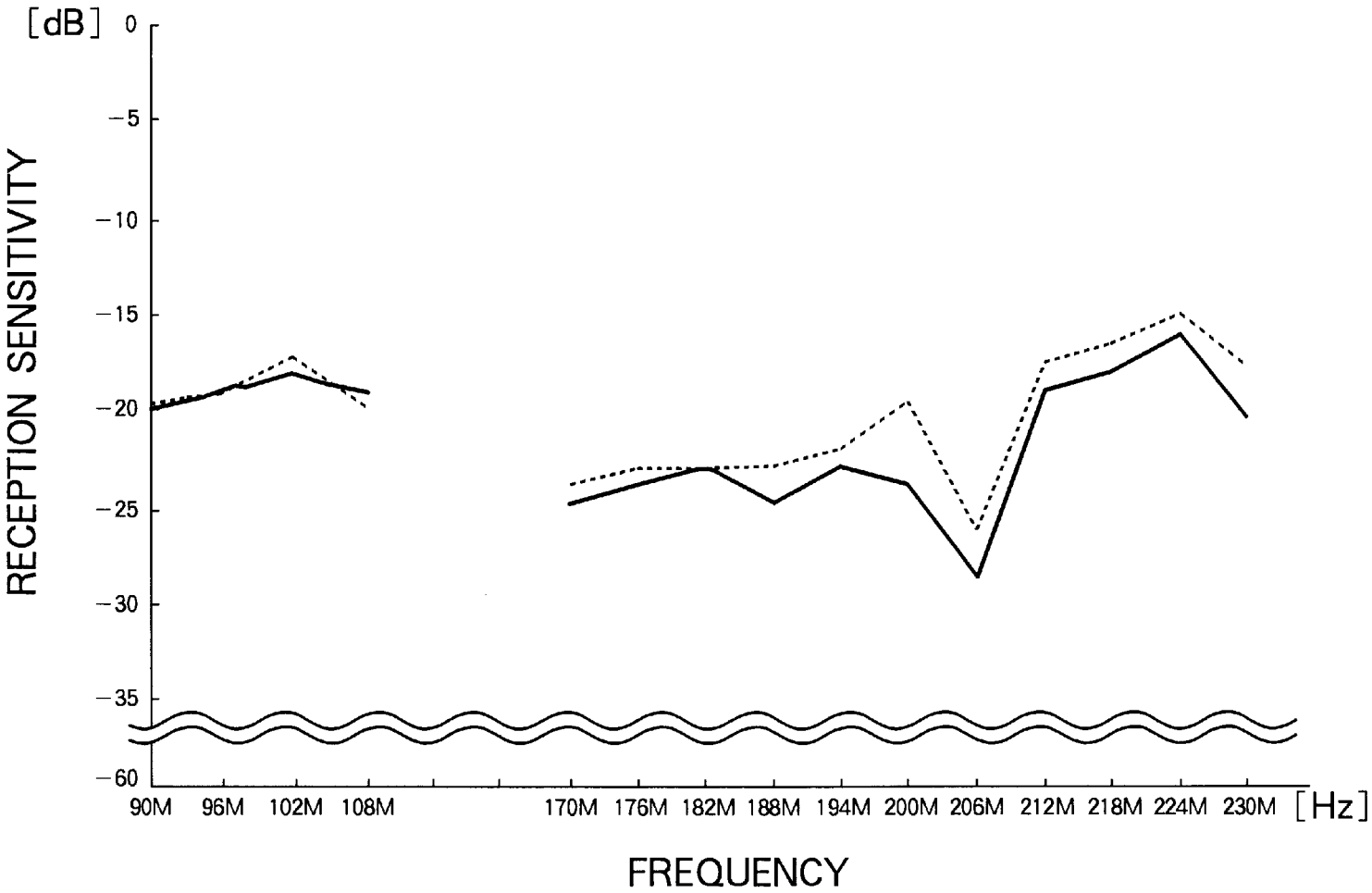
FIG. 3 is a comparative graphical illustration of the reception sensitivity of the inventive window glass antenna system and a prior window glass antenna system.
Figure 4:
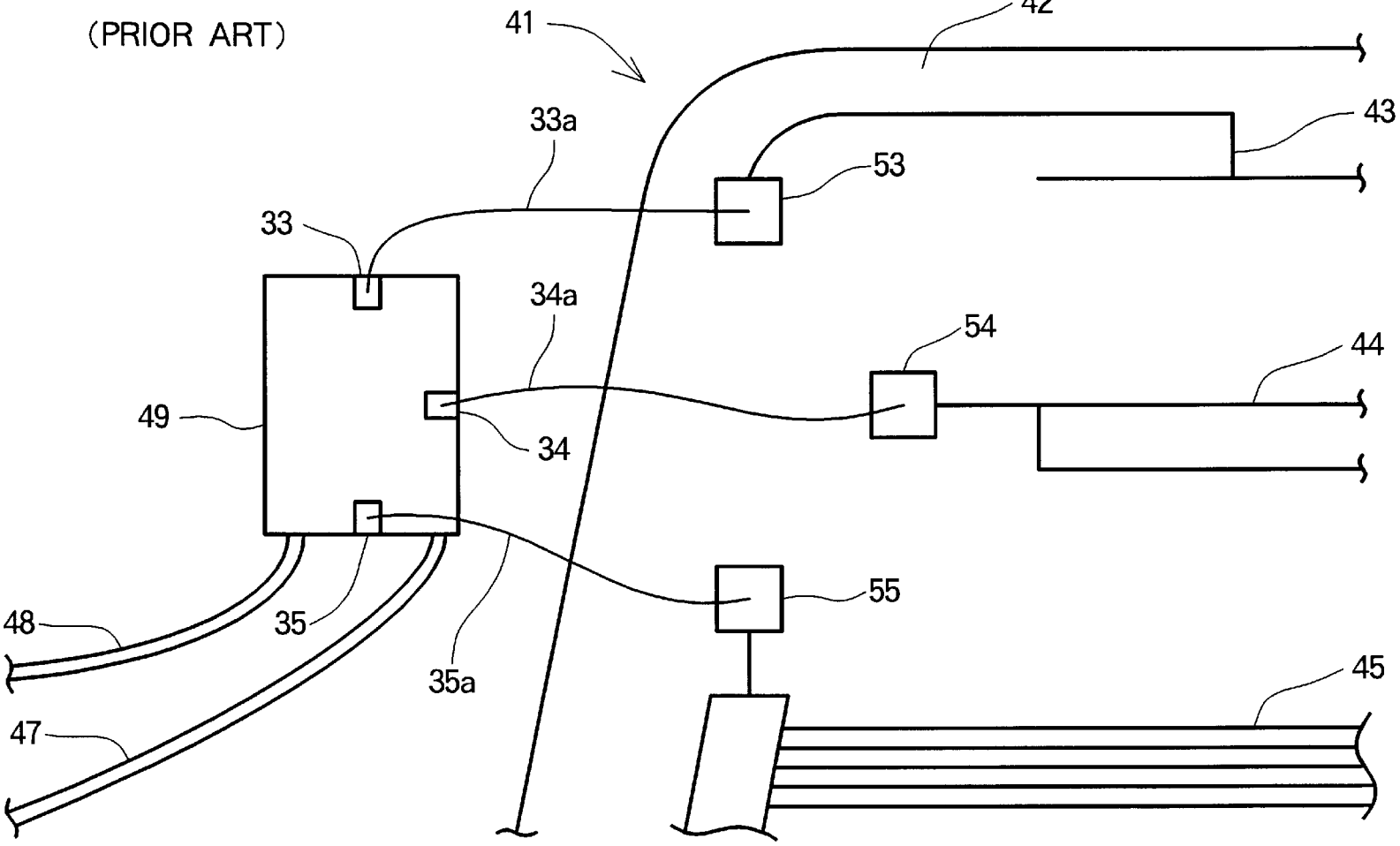
FIG. 4 (PRIOR ART)
FIG. 4 is a schematic view illustrating a general arrangement of the prior window glass antenna system.

Referring now to FIG. 3, dotted line represents the reception sensitivity of the inventive window glass antenna system shown in FIG. 1. Solid line represents the reception sensitivity of the prior window antenna system shown in FIG. 4. Frequency range of 90 MHz–108 MHz corresponds to the radio frequency band while 170 MHz–230 MHz corresponds to the TV frequency band.

As is apparent from FIG. 3, direct attachment of the printed-circuit board (antenna switching circuit) onto the surface of the window glass provides the inventive window glass antenna system with improved reception sensitivity.

The antenna switching circuit may be applied to diversity antennas widely known among skilled artisans.

Adhesive may be provided between the window glass and printed-circuit board or a printed film so that the latter can be interconnected more firmly.

Figure 2:
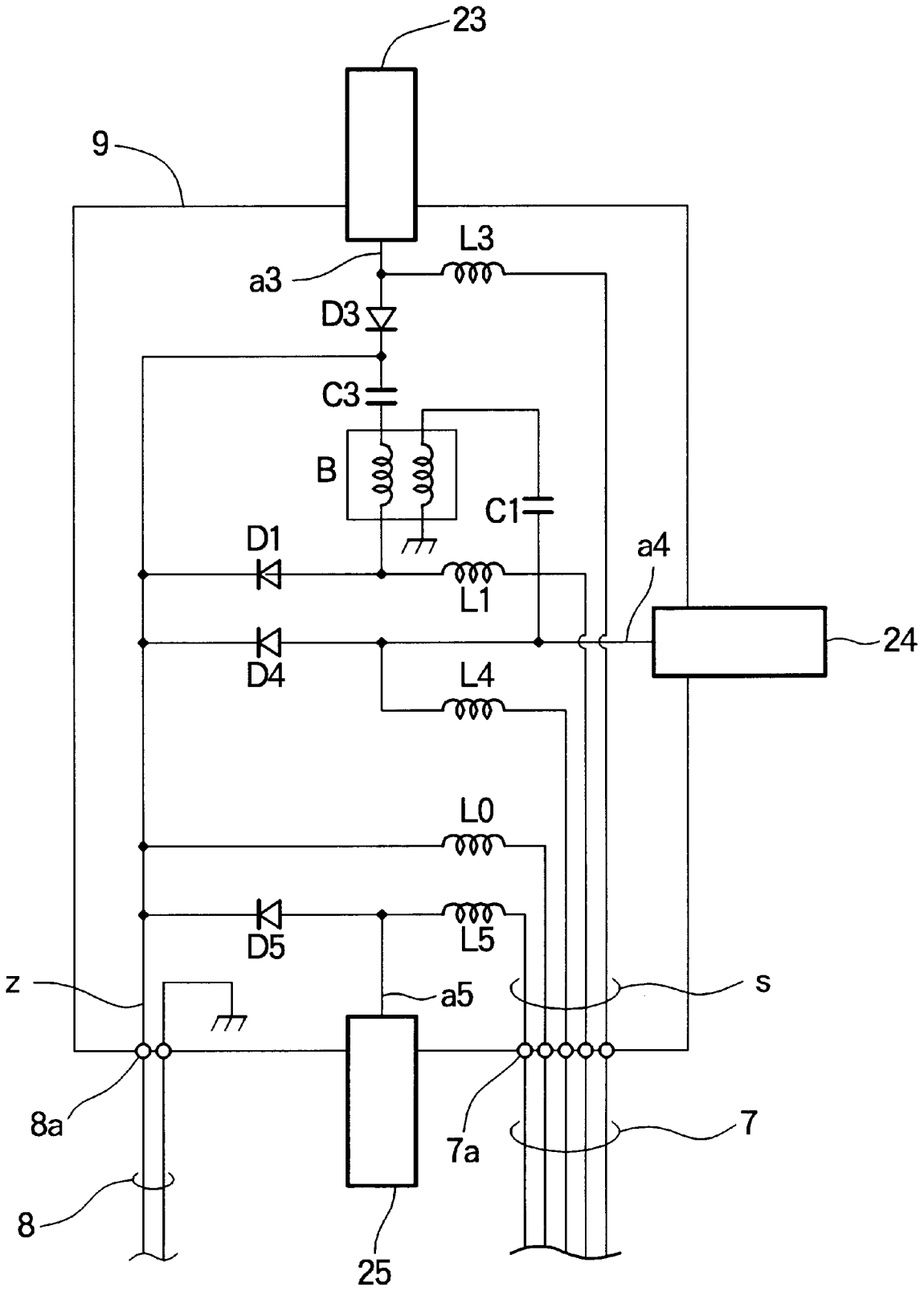
FIG. 2 is a circuit diagram showing an antenna switching circuit of the window glass antenna system.

Other than the circuit shown in FIG. 2, various other selector circuits may be applied to the antenna switching circuit.

As thus far explained in detail, the antenna switching circuit takes the form of a printed-circuit board or printed film and has plural mounting terminals. This enabled mounting of the switching circuit directly onto the window glass surface in close proximity to the antennas. As a result, the antenna switching circuit, or printed-circuit board or a printed film, can be connected directly to the antenna powering terminals, without requiring the use of elements that may vary the stray capacitance or form part of the antennas during operation thereof, whereby improved directional repeatability and reception sensitivity can be achieved in the window glass antenna system.

The foregoing discussion discloses and describes merely an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A window glass antenna system comprising:

a plurality of antennas attached to a surface of a vehicular window glass;

a plurality of power terminals attached to said window glass surface and connected to said antennas for supplying power thereto; and an antenna switching circuit attached directly onto said window glass surface in close proximity to said antennas for switching over said antennas, said antenna switching circuit having a plurality of mounting terminals and a plurality of input signal lines connected to said mounting terminals, said mounting terminals being fixedly secured to said power terminals.

2. A window glass antenna system according to claim 1, wherein said antenna switching circuit takes the form of a printed-circuit board, and said mounting terminals are provided on said printed-circuit board.

3. A window glass antenna system according to claim 1, wherein said antenna switching circuit takes the form of a printed film, and said mounting terminals are provided on said printed film.

4. A window glass antenna system according to claim 1, 2 or 3, wherein one of said antennas is a defogging-heater/antenna operable as a defogging heater and an antenna.

* * * * *